US007334286B2

(12) United States Patent
Kayser

(10) Patent No.: US 7,334,286 B2
(45) Date of Patent: Feb. 26, 2008

(54) TOOTHBRUSH AND METHODS OF MAKING AND USING SAME

(75) Inventor: Steven L. Kayser, San Diego, CA (US)

(73) Assignee: Loops, LLC, Ferndale, WA (US)

( * ) Notice: Subject to any disclaimer, the term of this patent is extended or adjusted under 35 U.S.C. 154(b) by 318 days.

(21) Appl. No.: 10/920,822

(22) Filed: Aug. 18, 2004

(65) Prior Publication Data

US 2006/0037160 A1 Feb. 23, 2006

(51) Int. Cl.
*A46B 9/04* (2006.01)
*A46B 5/02* (2006.01)

(52) U.S. Cl. ..... 15/167.1; 15/143.1; 15/172

(58) Field of Classification Search ..... 15/167.1, 15/143.1, 172; 401/49
See application file for complete search history.

(56) References Cited

U.S. PATENT DOCUMENTS 5,291,878 A * 3/1994 Lombardo et al. ..... 601/139
5,630,244 A * 5/1997 Chang ..... 15/167.1
5,778,478 A 7/1998 Coleman
6,295,686 B1 * 10/2001 Phillips ..... 15/167.1
6,298,516 B1 * 10/2001 Beals et al. ..... 15/143.1
6,546,583 B1 * 4/2003 Rohrig ..... 15/110
6,668,416 B1 * 12/2003 Georgi et al. ..... 15/167.1
2003/0208870 A1 * 11/2003 Jimenez ..... 15/167.1

FOREIGN PATENT DOCUMENTS

EP 336641 A2 * 10/1989
WO WO 0129128 A1 * 4/2001

* cited by examiner

*Primary Examiner*—Shay L Karls
(74) *Attorney, Agent, or Firm*—Bernard L. Kleinke; Duckor Spradling Metzger & Wynne

(57) ABSTRACT

The disclosed embodiments relate to a toothbrush and methods of making and using it, wherein an elongated body has a bristle brush head portion and a handle portion. The body is composed of flexible material so that the handle portion can be grasped in the hand of the user, and the user can flex the elongated body into a substantially rigid position for teeth brushing purposes.

32 Claims, 1 Drawing Sheet

TOOTHBRUSH AND METHODS OF MAKING AND USING SAME

FIELD OF THE INVENTION

The present invention related in general to a toothbrush and methods of making and using it. It more particularly relates to such a toothbrush, which is compact in size and may be safely used by prison inmates.

BACKGROUND ART

There is no admission that the background art described in this section legally constitutes prior art.

Prison and other detention systems monitor devices permitted to be used by inmates to prevent the use of otherwise safe device as a weapon. For example, conventional toothbrushes are not permitted to be used by many prison systems because they may be fashioned into a pointed shaft or rod or otherwise used as a shank for a sharp object such as a razor blade, which could be used to endanger other inmates as well as security personnel.

In an attempt to provide a safe alternative toothbrush for use by inmates for dental hygiene purposes, a toothbrush is currently being used which includes a brush head and a very short handle. The handle is so short that it must be grasped by only the thumb and forefinger of the user. However, such a toothbrush is awkward to use. The fingers of the user may be required to enter the mouth to reach all of the teeth. Such a difficult to use toothbrush may result in inadequate teeth cleaning, and be awkward and uncomfortable to use. Such ineffectual cleaning procedures may cause, or at the least contribute to, poor dental hygiene, thereby leading to costly dental procedures in some instances.

BRIEF DESCRIPTION OF THE DRAWINGS

The following is a brief description of the drawings.

DETAILED DESCRIPTION OF CERTAIN EMBODIMENTS OF THE INVENTION

Figure 1:
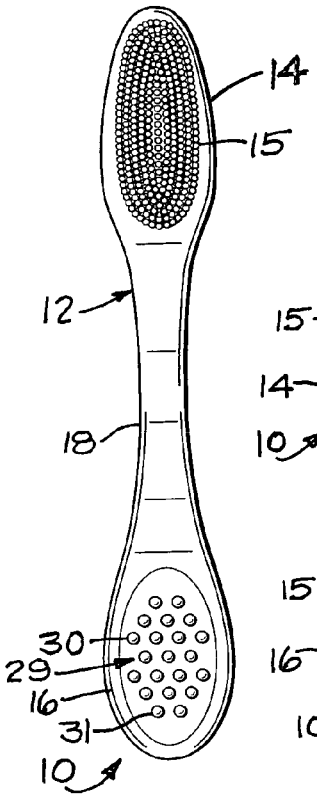
FIG. 1 is a plan view of the underside of a toothbrush, which is constructed according to an embodiment of the invention.
Figure 2:
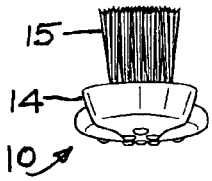
FIG. 2 is a front end view of the toothbrush of FIG. 1.
Figure 3:
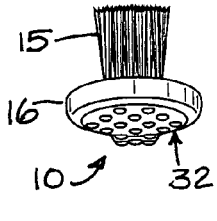
FIG. 3 is a rear end view of the toothbrush of FIG. 1.

The disclosed embodiments relate to a toothbrush and methods of making and using it, wherein an elongated body has a bristle brush head portion and a handle portion. The body is composed of flexible material so that the handle portion can be grasped in the hand of the user, and the user can flex the elongated body into a substantially rigid position for teeth brushing purposes.

According to other embodiments, the length of the body is up to about 4.5 inches.

According to still other embodiments of the invention, the material of the body may be composed of an extrudable elastomer selected from the group consisting of silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS and SIBS-triblock copolymers, and acrylic rubber.

According to further embodiments of the invention, there is provided a method of using a toothbrush by grasping a handle portion in the hand of the user, and pressing on a portion of the elongated body of the toothbrush with a digit of the user to flex the elongated body into a substantially rigid flexed position. The teeth may then be brushed for cleaning purposes. According to the disclosed embodiments, the pressing on the body may include moving the digit of the user into contact with a digit engageable portion of the body, and the flexed position may include the brush head portion of the toothbrush disposed at an angle of about 45 degrees relative to the handle portion.

Referring now to the drawings, and more particularly to FIGS. 1, 2, 3, 4, and 5 thereof, there is shown a toothbrush 10, which may be constructed in accordance with an embodiment of the invention. The toothbrush 10 includes an elongated body 12 having a bristle brush head portion 14 having a bristle brush 15 extending therefrom. The elongated body 12 includes a handle portion 16 and a narrowed intermediate portion 18 integrally connecting the head portion 14 and the handle portion 16.

A digit engageable irregular surface 20 on the upper surface of the intermediate portion 18 is adapted to be engaged by a digit of the user to help flex it into a substantially rigid position for brushing the teeth. The digit engageable irregular surface 20 includes a rigided surface 21 formed of projections or ridges such as the ridges 23 and 25 to facilitate grasping the body 12 with a digit of the user. While it is shown and described that the thumb of the user may engage the surface 20, it is contemplated that a finger such as an index finger may also be preferedly be used to press on the surface 20, instead of the thumb.

Figure 4:
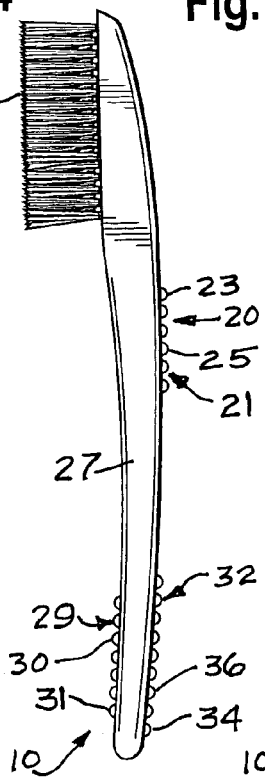
FIG. 4 is a side end view of the toothbrush of FIG. 1.
Figure 5:
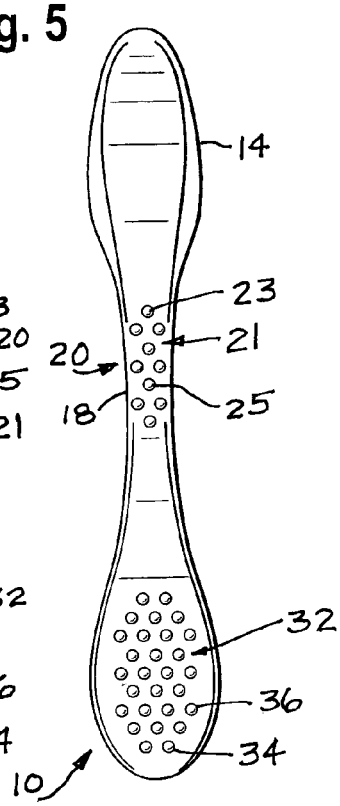
FIG. 5 is a plan view of the top side of the toothbrush of FIG. 1.

As best seen in FIG. 4, the body 12 has a slightly curved side edge or curved aspect 27 between the head portion 14 and the handle portion 16, to help facilitate the flexing of the body 12 by the hand of the user. An irregular surface 29 on the underside of the handle portion 16 includes a group of projections or ridges such as ridges 30 and 31. Similarly, an irregular surface 32 on the top side of the handle portion 16 includes projections or ridges such as ridges 34 and 36. Thus, the irregular surfaces on the handle portion 16 facilitate the grasping of the handle portion when the hands are wet to help grasp the toothbrush 10 during use.

Figure 6:
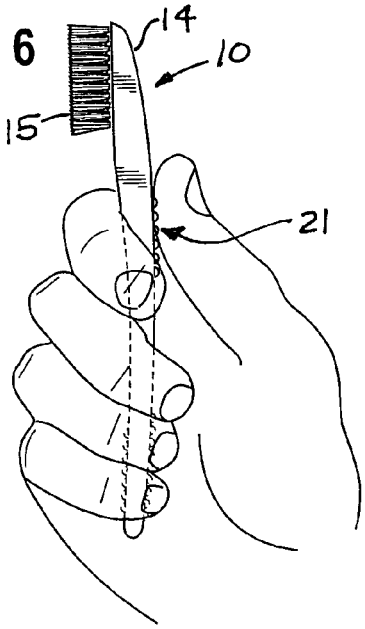
FIGS. 6 and 7 are reduced scale views similar to FIG. 4, illustrating it in the process of being used.
Figure 7:
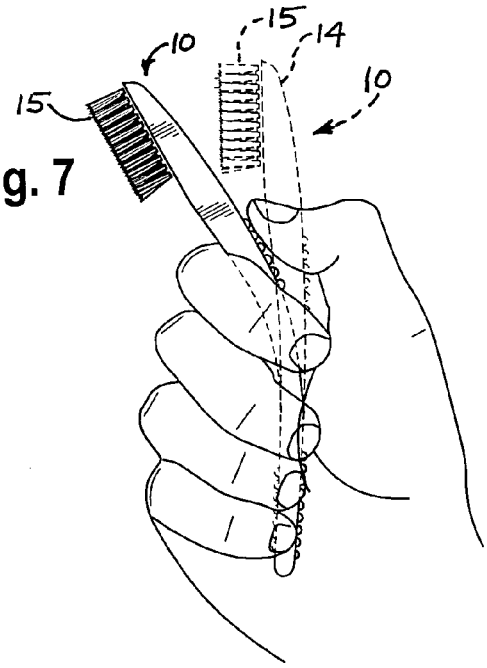

According to an embodiment of the invention, as shown in FIGS. 6 and 7, there is shown the placement of the combined thumb and index finger, or other convenient manner of holding the toothbrush 10 in the hand of the user to perform a tooth brushing operation. The top half or head portion 14 of the toothbrush 10 is positioned by flexing the body 12 to cause the head portion 14 to assume a position in about a 45 degree angle relative to the handle portion 16 to facilitate the cleaning process. The use of the toothbrush 10 may require the combined use of an index finger and a thumb of the same hand. The head portion 14 and remaining portion, such as the intermediate portion 18, may be flexible or otherwise deformable or breakable or other, to prevent or limit the possibility of using or converting the toothbrush 10 to a shank/stabbing weapon device in an environment requiring safety such as prisons—and also to contribute to less abrasion and trauma to the teeth and gums while brushing.

In use, the digit such as the thumb, index finger or other may act as a guide to place the brush head portion 14 in an approximate 45 degree angle relative to the handle portion 16, to steady the head portion 14, to help direct the head portion 14 into the mouth and place the head portion 14 into engagement with the teeth, and to steady the flexible intermediate portion 18 and head portion 14, while using the brush 15 in the act of brushing the teeth.

The placement of the digit such as the thumb, index finger or other on or near the ridges of the irregular surface 20 helps to alleviate slippage if the body 12 becomes wet. The ridges such as ridge 23 and 25 may be increased or decreased in number and arrangement or the irregular area expanded in area or length.

For the purposes of safety (i.e. prison market) the length of the body 12 of the toothbrush 10 should be up to approximately 4½ inches in length. More preferably, the length of the body 12 is between about 3.0 inches and 4.5 inches. Still more preferably, the length of the body 12 is between about 3.5 inches and about 4.5 inches. The most preferred length of the body 12 is about 4.5 inches.

The head portion 14 may have a slightly wider head portion 14 as shown in FIG. 1. Also, the intermediate portion 18 may vary in width, and may be wider than the portion 18 shown in FIG. 1. Additionally, the hardness of the material of the body 12 may vary, depending on the degree of safety desired and the selection of the material. A harder material may affect the need for more pressure exertion by the digit of the user. The preferred hardness is a durometer hardness of between about 75 and about 95.

It should be understood that the toothbrush 10 may be used for a variety of purposes. It may be used for cleaning the teeth of animals such as pets. The toothbrush 10 may be used in travel kits due to its compact size. For such applications, a harder material may be used, and result in less reliance on the digit pressing on the irregular surface 20 to guide the head portion 14 and the length of the brush 15 may vary. For example, a longer handle portion 16 and less flexible material may be employed for a larger pet.

The more flexible the materials, the less safety risk (for the prison environment). The hardness of the material directly affects the flexibility. Different hardness of the material or different materials used, may tailor the toothbrush 10 to meet a range of safety concerns needed from maximum security prisons (the highest) down to minimum security prisons.

The bristles may be the same type or quality as are found in conventional toothbrushes, and may be soft, medium or firm. Oval shaped bristles may be employed, but other shapes such as square may be employed as well.

The toothbrush 10 when used in correctional facilities may lessen the risk to inmates and correctional officers from an inmate using the toothbrush 10 or modifying it as a slashing weapon device. Inmates can fashion such a weapon from a conventional hard plastic toothbrush by cutting a notch in the head or bottom of the handle to insert a razor blade, and either melt the material around the razor blade (or glass or similar sharp material) to hold the sharp object in place. After the melted area cools, such a device becomes a dangerous weapon for the use described. The embodiment of the invention may substantially lessen or eliminate the fashioning of such a device, because the material may not have the strength and rigidity of a conventional stiff handled toothbrush.

The toothbrush 10 may be constructed of a clear material, in part or all. The correctional market desires products that are either constructed of clear material to lessen the possibility of contraband being hidden. For the retail or pet markets, solid colored material may be employed.

Many conventional toothbrushes are designed with a lengthy handle, usually with some ergonomic design, but usually with an overall design to condition the user to grasp the handle with the entire hand and bring the entire stiff handled device to bear force and pressure on the teeth and gums. Such operation may cause pain and excessive wear and abrasion to teeth and gums.

The disclosed embodiment invention eliminates or lessens much of those negative characteristics. The user of the flexible handled toothbrush 10 can use much less force and pressure on teeth and gums with a small amount of pressure using the digit such as the thumb or index finger, to guide the head portion 14. Such construction tends to eliminate the use of the entire hand to manipulate a long, stiff conventional handle that is designed to be used with the entire hand and requiring ergonomic design to lessen the negative features of having to grasp with the entire hand a handle and twisting the wrist. A conventional long handled toothbrush requires twisting or manipulation of the hand and wrist. Whereas, the toothbrush 10 uses more manipulation of the digits and less wrist action to place the flexible head portion 14 onto the teeth to be cleaned.

The elongated body 12 may have added ridges positioned further up the inside of the handle, about an inch from the thumb area to prevent possible slippage in case the user places their thumb outside the intended area.

The different materials to construct the handle will also have some features to lessen slippage when the device is wet. Conventional toothbrushes use similar materials, such as the tactile feel of rubber.

There are areas left for product identification on the underside of the toothbrush 10 as well as the top area of the head 14, for incorporating into the mold or tooling for molding indicia (not shown) thereon.

Although the toothbrush 10 is currently preferred to accommodate the prison environment, the pet market could use a larger size body 12 to provide a longer handle. A possible application could also include the retail market and the travel kit market (space requirements for travel kits necessitates downsized articles—i.e., a short handle toothbrush) or a device with a handle extension.

The head portion 14 may be a separate part and molded to the shaft during the manufacturing process. The bristles (number of cavities, and tufts or strands per cavity) should be similar to any conventional toothbrush. The head portion may vary in size, and may be sized to the mouth of an average user. Also, there may be different angles for the bristles 15. The bristles 15 may be inserted after the material of the body 12 partially or completely cools.

There may be different methods being used to insert the bristles. It should be noted that only a portion of the body 12 may be flexible or otherwise deformable.

A variety of material hardness of the body 12 may be employed to adjust the flexibility thereof to adjust the softness portion 14 to limit twisting thereof relative to the handle portion on 16.

Various modifications and changes may be made with respect to the foregoing detailed description certain embodiments of the invention as will become apparent to those skilled in the art without departing from the spirit of the present invention.

What is claimed is:

1. A toothbrush, comprising:

an elongated body having an enlarged smoothly rounded bristle brush head portion and a handle portion the elongated body has a top side and a bottom side; the elongated body has a length along the longitudinal axis, a width along the top and bottom side extending perpendicular to the longitudinal axis and a thickness extending perpendicular to the longitudinal axis between the top and bottom side of the body;

the brush head portion including a group of bristles located only on the bottom side of the body;

the bristles each having a length substantially the same as the width of the group of bristles on the bottom side;

the body being integral and composed of a sufficiently pliable flexible material throughout its length; and the handle portion being pliable and flexible along its entire length and including an enlarged smoothly rounded bulbous handle end portion to facilitate handling of the toothbrush and a narrowed elongated intermediate smooth continuous portion being composed of the pliable flexible material to be limber in its unstressed condition, and integrally connecting the enlarged head portion and the enlarged handle end portion substantially midway therebetween to facilitate flexing of the toothbrush with one hand of an adult user for stressing the pliable flexible material to rigidify the body for teeth brushing purposes;

the head portion, the intermediate portion, and the end portion each having substantially the same length;

the intermediate portion is narrower than the width of the head portion and the end portion on the top and bottom side;

the thickness of the elongated body at the head portion being tapered and increasing toward the intermediate portion, and at the intermediate and end portions being smoothly continuously tapered and smoothly continuously decreasing toward a narrowed tip of the end portion wherein the thickness of the elongated body is greatest at the intermediate portion;

the intermediate portion including a digit engageable portion on the top side the elongated body for engagement by a digit of the user's hand, the digit engageable portion being spaced by a sufficient distance from the bristle brush head portion when flexed to avoid the digit entering the user's mouth during brushing; and the handle portion extending between the brush head portion and the distal end of the bulbous handle end portion, wherein the flexibility of the material requires a manually applied external force by the digit of the hand of the user holding the toothbrush to flex the handle portion substantially along its entire length to make the body sufficiently rigid to facilitate use of the toothbrush for teeth brushing purposes, wherein the material of the body is sufficiently flexible to enable the manually applied external force to flex the handle portion into a smoothly rounded shape.

2. A toothbrush according to claim 1, wherein the material is durable and has a durometer hardness of between about 75 and about 95 on the Shore A scale.

3. A toothbrush according to claim 2, wherein the material is an extrudable elastomer.

4. A toothbrush according to claim 3, wherein the material is one selected from the group consisting of polyurethane, silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS and SIBS-triblock copolymers, and acrylic rubber.

5. A toothbrush according to claim 4, wherein the length of the body is between about 3.0 inches and about 4.5 inches.

6. A toothbrush according to claim 5, wherein the length of the body is about 3.5 inches.

7. A toothbrush according to claim 6, wherein the handle portion is wider than the brush head portion with the narrowed intermediate portion therebetween.

8. A toothbrush according to claim 7, wherein the digit engageable portion includes an irregular surface on the upper portion of the intermediate portion.

9. A toothbrush according to claim 8, further including irregular surfaces on the upper and lower portions of the handle portion.

10. A toothbrush according to claim 9, wherein each one of the irregular surfaces includes a group of projections.

11. A toothbrush according to claim 1, wherein the length of the body is between about 3.0 inches and about 4.5 inches.

12. A toothbrush according to claim 11, wherein the length of the body is between about 3.5 inches and about 4.5 inches.

13. A toothbrush according to claim 1, wherein the handle portion is wider than the brush head portion with the narrowed intermediate portion therebetween.

14. A toothbrush according to claim 13, wherein the digit engageable portion includes an irregular surface on the upper portion of the intermediate portion.

15. A toothbrush according to claim 14, further including irregular surfaces on the upper and lower portions of the handle portion.

16. A toothbrush according to claim 15, wherein each one of the irregular surfaces includes a group of projections.

17. A toothbrush according to claim 1, wherein the body has a curved edge extending between the brush head and the handle portion.

18. A toothbrush, comprising:

an elongated body having a bristle brush head portion and a handle portion the elongated body has a top side and a bottom side; the elongated body has a length along the longitudinal axis, a width along the top and bottom side extending perpendicular to the longitudinal axis and a thickness extending perpendicular to the longitudinal axis between the top and bottom side of the body;

the brush head portion including a group of bristles located only on the bottom side of the body;

the bristles each having a length substantially the same as the width of the group of bristles on the bottom side;

the handle portion being pliable and flexible along its entire length and including an enlarged smoothly rounded bulbous handle end portion to facilitate handling of the toothbrush and a narrowed elongated intermediate smooth continuous portion being limber in its unstressed condition, and integrally connecting the enlarged head portion and the enlarged handle end portion substantially midway therebetween to facilitate flexing of the toothbrush with one hand of an adult user to rigidify the body for teeth brushing purposes;

the head portion, the intermediate portion, and the end portion each having substantially the same length;

the width of the intermediate portion is narrower than the width of the head portion and the end portion on the top and bottom side;

the thickness of the elongated body at the head portion being tapered and increasing toward the intermediate portion, and at the intermediate and end portions being smoothly continuously tapered and smoothly continuously decreasing toward a narrowed tip of the end portion wherein the thickness of the elongated body is greatest at the intermediate portion;

the intermediate portion including a digit engageable portion on the top side of the elongated body for engagement by a digit of the user's hand, the digit engageable portion being spaced by a sufficient distance from the bristle brush head portion when flexed to avoid the digit entering the user's mouth during brushing;

the handle portion extending between the brush head portion and the distal end of the bulbous handle end portion; and the body being integral and composed of a flexible material selected from the group consisting of silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS and SIBS-triblock copolymers, and acrylic rubber, wherein the flexibility of the material requires a manually applied external force by the digit of the hand of the user holding the toothbrush to flex the handle portion substantially along its entire length to make the body sufficiently rigid to facilitate use of the toothbrush for teeth brushing purposes, wherein the material of the body is sufficiently flexible to enable the manually applied external force to flex the handle portion into a smoothly rounded shape.

19. A toothbrush according to claim 18, wherein the length of the body is between about 3.0 inches and about 4.5 inches.

20. A toothbrush comprising:

an elongated body having a bristle brush head portion and a handle portion the elongated body has a top side and a bottom side; the elongated body has a length along the longitudinal axis, a width along the top and bottom side extending perpendicular to the longitudinal axis and a thickness extending perpendicular to the longitudinal axis between the top and bottom side of the body;

the handle portion extending from the brush head portion;

the brush head portion including a group of bristles located only on the bottom side of the body;

the bristles each having a length substantially the same as a length of the width of the group of bristles on the bottom side; and the body being integral and composed of pliable flexible material, wherein the handle portion is wider than the brush head portion and has a narrowed elongated intermediate smooth continuous portion being composed of the pliable flexible material to be limber in its unstressed condition therebetween, and the flexibility of the material requires a manually applied external force by a digit of the hand of an adult user holding the toothbrush to flex the handle portion substantially along its entire length to make the body sufficiently rigid to facilitate use of the toothbrush for teeth brushing purposes, wherein the width of the intermediate portion is narrower than the width of the head portion and a remaining end portion of the handle portion on the top and bottom side;

wherein the head portion, the intermediate portion, and the end portion each having substantially the same length, wherein the thickness of the elongated body at the head portion being tapered and increasing toward the intermediate portion, and at the handle portion being smoothly continuously tapered and smoothly continuously decreasing toward a narrowed tip of the handle portion wherein the thickness of the elongated body is greatest at the intermediate portion;

wherein the material of the body is sufficiently flexible to enable the manually applied external force to flex the handle portion into a smoothly rounded shape.

21. A toothbrush according to claim 20, further including a finger engageable irregular surface on the upper portion of the intermediate portion.

22. A toothbrush according to claim 21, further including irregular surfaces on the upper and lower portions of the handle portion.

23. A toothbrush according to claim 22, wherein each one of the irregular surfaces includes a group of projections.

24. A toothbrush according to claim 23, wherein the body has a curved edge extending between the brush head and the handle portion.

25. A method of making a toothbrush, comprising:

molding a body of a pliable flexible material, and molding the body to include a brush head portion and a handle portion, the elongated body has a top side and a bottom side; the elongated body has a length along the longitudinal axis, a width along the top and bottom side extending perpendicular to the longitudinal axis and a thickness extending perpendicular to the longitudinal axis between the top and bottom side of the body;

the brush head portion including a group of bristles located only on the bottom side of the body, the bristles each having a length substantially the same as the width of the group of bristles on the bottom side; and molding the handle portion to be pliable and flexible along its entire length and include an enlarged smoothly rounded bulbous handle end portion to facilitate handling of the toothbrush and a narrowed elongated intermediate smooth continuous portion being composed of the pliable flexible material to be limber in its unstressed condition and integrally connecting the enlarged head portion and the enlarged handle end portion substantially midway therebetween to facilitate flexing of the toothbrush with one hand of an adult user for stressing the pliable flexible material to rigidify the body for teeth brushing purposes, the intermediate portion including a digit engageable portion on the top side of the elongated body for engagement by a digit of the user's hand, the digit engageable portion being spaced by a sufficient distance from the bristle brush head portion when flexed to avoid the digit entering the user's mouth during brushing, wherein the body has a length of up to about 4.5 inches, wherein the head portion, the intermediate portion, and the end portion each have substantially the same length, wherein the width of the intermediate portion is narrower than the width of the head portion and the end portion on the top and bottom side;

wherein the thickness of the elongated body at the head portion being tapered and increasing toward the intermediate portion, and at the intermediate and end portions being smoothly continuously tapered and smoothly continuously decreasing toward a narrowed tip of the end portion wherein the thickness of the elongated body is greatest at the intermediate portion;

wherein the material is one selected from the group consisting of polyurethane, silicone, neoprene, EPDM, nitrile, fluoroelastomers, natural rubber, styrene-butadiene rubber, thermoplastic elastomers, polyvinyl alcohol, PMMA, polyamide, polyester terephthalate, polycarbonate, polyetherimide, polyethylene (LDPE, HDPE, LLDPE, and blends), polypropylene and copolymers, polysulfone, polyvinyl chloride, viton, PUNA nitrile, carboxylated nitrile, polysulfides, alpha olefin elastomers, conjugated diene elastomers, hydrogenated diene elastomers, ethylene carboxylate, ethylene-propylene-diene elastomers, functionalized ethylene-vinyl acetate, SB-diblock copolymers, SBS and SIBS-triblock copolymers, and acrylic rubber, wherein the flexibility of the material requires a manually applied external force by the digit of the hand of the user holding the toothbrush to flex the handle portion substantially along its entire length to make the body sufficiently rigid to facilitate use of the toothbrush for teeth brushing purposes, wherein the material of the body is sufficiently flexible to enable the manually applied external force to flex the handle portion into a smoothly rounded shape.

26. A method according to claim 25, wherein the length of the body is between about 3.0 inches and about 4.5 inches.

27. A method according to claim 26, wherein the length of the body is about 3.5 inches.

28. A method according to claim 27, wherein the handle portion is wider than the brush head portion with the narrowed intermediate portion therebetween.

29. A method according to claim 28, wherein the digit engageable includes an irregular surface on the upper portion of the intermediate portion.

30. A method according to claim 29, further including irregular surfaces on the upper and lower portions of the handle portion.

31. A method according to claim 30, wherein each one of the irregular surfaces includes a group of projections.

32. A method according to claim 31, wherein the body has a curved edge extending between the brush head and the handle portion.

* * * * *

UNITED STATES PATENT AND TRADEMARK OFFICE

CERTIFICATE OF CORRECTION

PATENT NO. : 7,334,286 B2
APPLICATION NO. : 10/920822
DATED : August 18, 2004
INVENTOR(S) : Steven L. Kayser It is certified that error appears in the above-identified patent and that said Letters Patent is hereby corrected as shown below:

Claim 1, column 5, line 32, before “intermediate” insert -- width of the --
Claim 1, column 5, line 43, after “side” insert -- of --
Claim 20, column 7, line 64, delete “a length of”

Signed and Sealed this

Twenty-seventh Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,334,286 B2
APPLICATION NO. : 10/920822
DATED : February 26, 2008
INVENTOR(S) : Steven L. Kayser It is certified that error appears in the above-identified patent and that said Letters Patent is hereby corrected as shown below:

Claim 1, column 5, line 32, before "intermediate" insert -- width of the --
Claim 1, column 5, line 43, after "side" insert -- of --
Claim 20, column 7, line 64, delete "a length of"

This certificate supersedes the Certificate of Correction issued May 27, 2008.

Signed and Sealed this

Twenty-fourth Day of June, 2008

JON W. DUDAS
*Director of the United States Patent and Trademark Office*